US012429318B1

(12) United States Patent
MacDonald et al.

(10) Patent No.: US 12,429,318 B1
(45) Date of Patent: Sep. 30, 2025

(54) SUBMUNITION ASSEMBLY

(71) Applicant: Raytheon Company, Arlington, VA (US)

(72) Inventors: Paul S. MacDonald, Tiverton, RI (US); Jaylan S. Jones, Tucson, AZ (US); Jessie A. Polanco, Tucson, AZ (US); Shawn P. Burke, Omaha, NE (US)

(73) Assignee: Raytheon Company, Arlington, VA (US)

( * ) Notice: Subject to any disclaimer, the term of this patent is extended or adjusted under 35 U.S.C. 154(b) by 0 days.

(21) Appl. No.: 18/731,968

(22) Filed: Jun. 3, 2024

(51) Int. Cl.
*F42B 12/60* (2006.01)
*F42B 10/56* (2006.01)

(52) U.S. Cl.
CPC ..... *F42B 12/60* (2013.01); *F42B 10/56* (2013.01)

(58) Field of Classification Search
CPC ..... F42B 12/58; F42B 12/60; F42B 12/62; F42B 12/625
USPC ..... 102/489; 244/137.4
See application file for complete search history.

(56) References Cited

U.S. PATENT DOCUMENTS 3,093,072 A * 6/1963 Pigman ..... F42B 12/60 102/393
4,172,407 A 10/1979 Wentink
4,726,297 A 2/1988 Bueno et al.
5,016,839 A 5/1991 Frehaut et al.
5,188,315 A 2/1993 Foitzik et al.
5,239,927 A 8/1993 Frye et al.
5,253,588 A 10/1993 Vogt et al.
5,386,781 A 2/1995 Day
5,760,330 A 6/1998 Himmert et al.
6,056,237 A 5/2000 Woodland
6,082,675 A 7/2000 Woodall, Jr. et al.
6,498,767 B2 12/2002 Carreiro
6,626,400 B1 9/2003 Booth
(Continued)

FOREIGN PATENT DOCUMENTS

EP 0049778 A1 * 4/1982 ..... F42B 12/58
EP 1446629 B1 9/2010
(Continued)

OTHER PUBLICATIONS

EP 0049778 A1 Translation (Year: 1982).*

*Primary Examiner* — Reginald S Tillman, Jr.
(74) *Attorney, Agent, or Firm* — Schwegman Lundberg & Woessner, P.A.

(57) ABSTRACT

A submunition assembly to be stored and deployed from an aerial vehicle, particularly a supersonic vehicle, includes a container having at least first and second walls that are joined at one end by a hinge that together define a volume along an axis perpendicular to the hinge that contains a submunition. The submunition assembly is suitably axially-shaped with a rigid parachute panel positioned around the hinge to separate and deploy a parachute. The container may have an internal volume that is conformal to the submunition. The container may have an exterior shape that is either optimized for free-fall or has a portion that provides a conformal surface for the aerial vehicle. The submunition assembly may be configured so that all processing, memory and data resides with the submunition, which issues any and all commands to control the container including separation of the rigid parachute panel and opening of the container to release the submunition.

20 Claims, 9 Drawing Sheets

(56) References Cited

U.S. PATENT DOCUMENTS

| | | | |
|---|---|---|---|
| 6,659,012 | B1 | 12/2003 | Grassl et al. |
| 6,672,220 | B2 | 1/2004 | Brooks et al. |
| 6,905,097 | B2 | 6/2005 | Blackwell-thompson et al. |
| 6,957,609 | B2 | 10/2005 | Ronn et al. |
| 7,032,521 | B2 | 4/2006 | Ronn et al. |
| 7,395,761 | B2 | 7/2008 | Bittle et al. |
| 7,494,089 | B2 | 2/2009 | Williams et al. |
| 7,908,973 | B2 | 3/2011 | De Lair et al. |
| 8,082,848 | B2 | 12/2011 | Hlavacek et al. |
| 8,708,285 | B1 | 4/2014 | Carreiro |
| 8,985,025 | B1 | 3/2015 | Manz et al. |
| 10,458,765 | B2 | 10/2019 | Hagberg et al. |

FOREIGN PATENT DOCUMENTS

| | | | | |
|---|---|---|---|---|
| GB | 2392227 A * | 2/2004 | ..... | F42B 10/56 |
| WO | WO-2009022995 A2 * | 2/2009 | ..... | A62C 3/025 |

* cited by examiner

SUBMUNITION ASSEMBLY

BACKGROUND

Field

This disclosure relates to submunition assemblies to be stored and deployed from an aerial vehicle, particularly a supersonic vehicle, that subsequent to deployment release a submunition.

Description of the Related Art

Aerial vehicles, typically missiles, unmanned aerial vehicles (UAVs) or the like, may be configured to deliver and deploy multiple submunitions into a theater of operations. The submunitions are stored within the aerial vehicle and then ejected at the desired time and location.

U.S. Pat. No. 6,056,237 entitled "Sonotube Compatible Unmanned Aerial Vehicle and System" issued May 2, 2000 discloses a rotary launcher assembly 31 designed to hold a plurality of payload packages 37 in separate compartments 210. The payload packages 37 are configured as generally cylindrical canisters. As a particular payload package is desired to be deployed, rotary launcher assembly 31 rotates the desired payload package into deployment position. Payload packages 37 are released through either one or all of the payload release doors 38, which are opened or closed by a pair of payload release door actuators 39.

U.S. Pat. No. 8,708,285 entitled "Micro-Unmanned Aerial Vehicle Deployment System" issued Apr. 29, 2014 discloses a micro-unmanned aerial vehicle deployment system for a cruise missiles. Each of six submuntions compartments can hold a submunition that is separately ejectable from a payload module. The payload module comprises a shell that provides environmental protection to the internal components and acts as a launch platform for MUAV's. Upon ejection of the payload module, a lanyard pulls a closure door (stored below the payload module) that rotates about a hinge and latches to reform the conformal surface of the cruise missile. The lanyard breaks leaving the payload module to fall and deploy a parachute. When the payload assembly reaches a pre-programmed altitude, or on remote command, latches are fired thereby separating the walls of the shell to release the MUAVs.

SUMMARY

The following is a summary that provides a basic understanding of some aspects of the disclosure. This summary is not intended to identify key or critical elements of the disclosure or to delineate the scope of the disclosure. Its sole purpose is to present some concepts of the disclosure in a simplified form as a prelude to the more detailed description and the defining claims that are presented later.

The present disclosure provides a submunition assembly to be stored and deployed from an aerial vehicle, particularly a supersonic vehicle, that subsequent to deployment releases a submunition.

In an embodiment, the submunition assembly includes a container having at least first and second walls that are joined at one end by a hinge that together define a volume along an axis perpendicular to the hinge. A submunition is positioned inside the container. The container has an "axial" shape defined as a length/width ratio of at least 1:1, typically at least 2:1 and possibly greater than 5:1. The interior of the axially shaped container may conform to the shape of the submunition. The exterior of the axially shaped container may be optimized aerodynamically for free-fall or may provide a conformal surface to complete the OML for the aerial vehicle. A streamer is deployed to orient the container during free-fall. A rigid parachute panel containing a parachute is positioned about the hinge and is configured to separate from the container and allow the parachute to deploy to slow the assembly during free-fall. Upon receipt of a release command, the walls pivot about the hinge to separate and release the submunition. The walls may include wedges that are engaged by the submunition to assist with opening the container.

In an embodiment, the submunition assembly is stored in and deployed from an airframe. When stored, at least a portion of one of the walls of the axially shaped container provide a conformal surface to complete the OML. A lock bracket having a receptacle and a pivot bracket are positioned at opposing ends of the container to receive a rod on the airframe and to engage a complementary hinge bracket positioned aft in the axial opening of the airframe. Upon deployment the rod is retracted and the container pivots away from the airframe and is released to free-fall.

In an embodiment, the submunition assembly container includes a plurality of separable walls and a mechanism to secure the walls. A submunition is positioned inside the container. The submunition includes a control unit configured to issue a command signal to the mechanism to separate the walls and open the container. The submunition is preferably hard-wired to the container to deliver the command signal. The control unit includes a processor and memory to process data to issue the command signal, wherein any and all processors or memory or data stored in memory or processed by the processor resides only with the submunition. The control unit may also issue a parachute command to release a rigid parachute panel (containing a parachute) from the container to deploy the parachute.

These and other features and advantages of the disclosure will be apparent to those skilled in the art from the following detailed description of preferred embodiments, taken together with the accompanying drawings, in which:

DETAILED DESCRIPTION

Figure 1A:
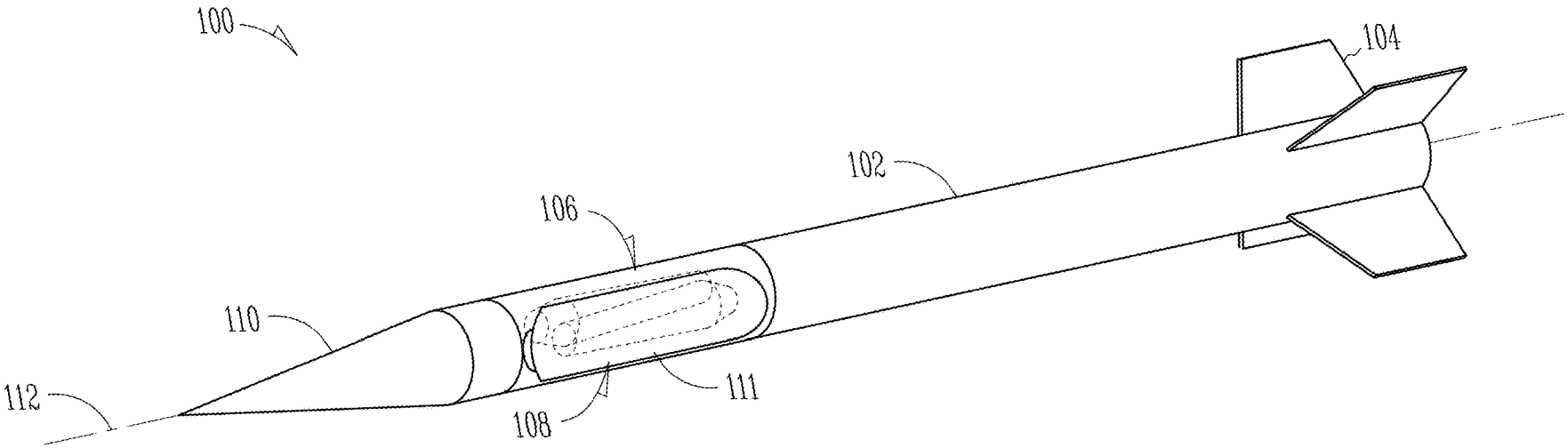
FIGS. 1A-1D illustrate an embodiment of a payload module in a supersonic airframe configured to store multiple submunition assemblies that conform to the OML of the airframe, deploy the multiple submunition assemblies, and rotate a skin to cover the openings left by the deployment of the submunition assemblies.
Figure 1B:
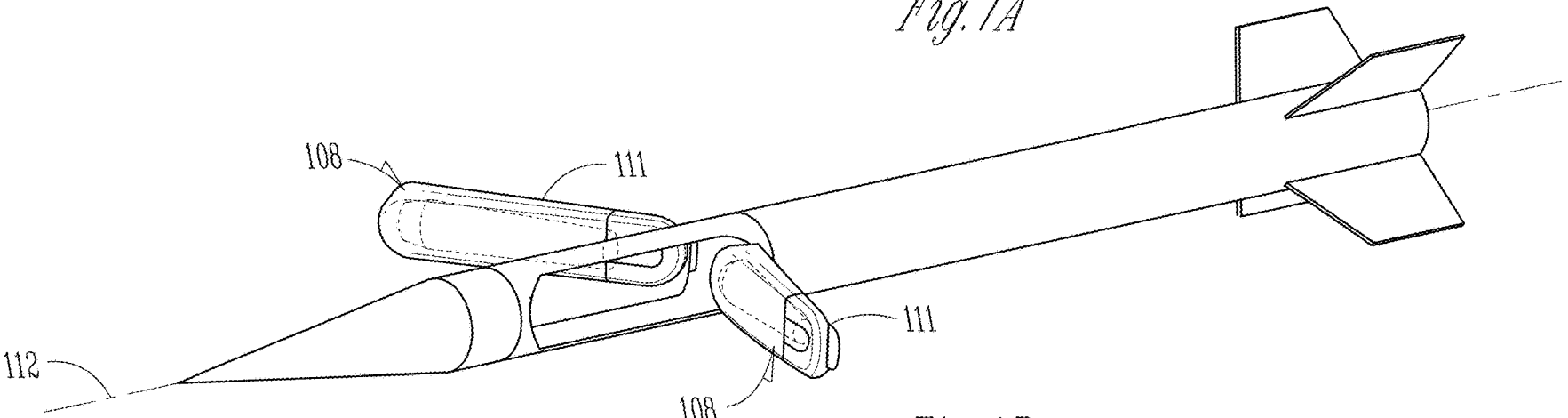
Figure 1C:
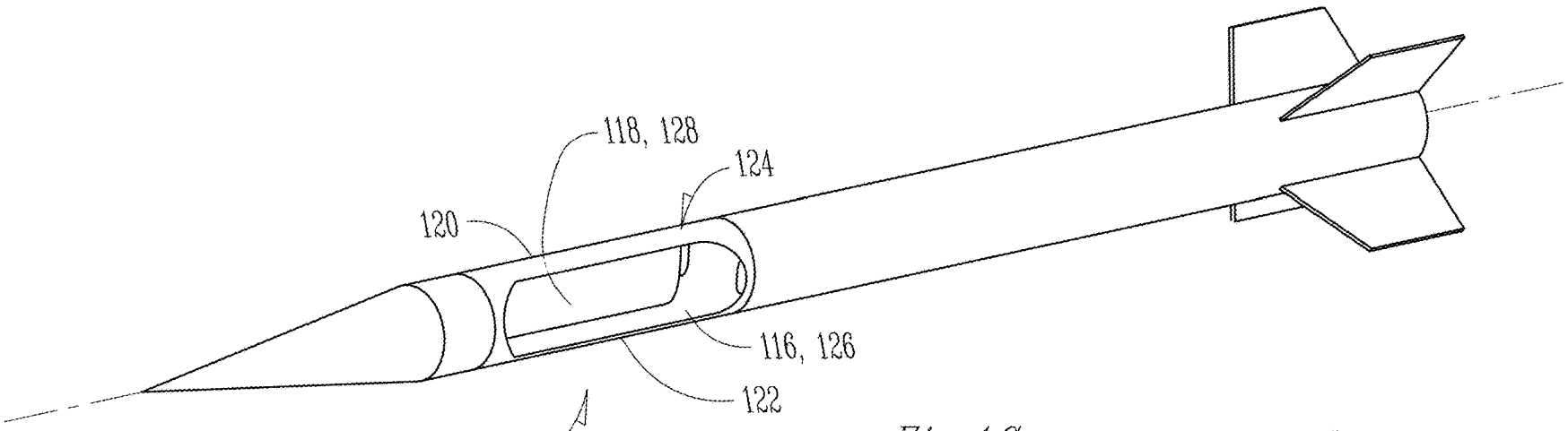
Figure 1D:
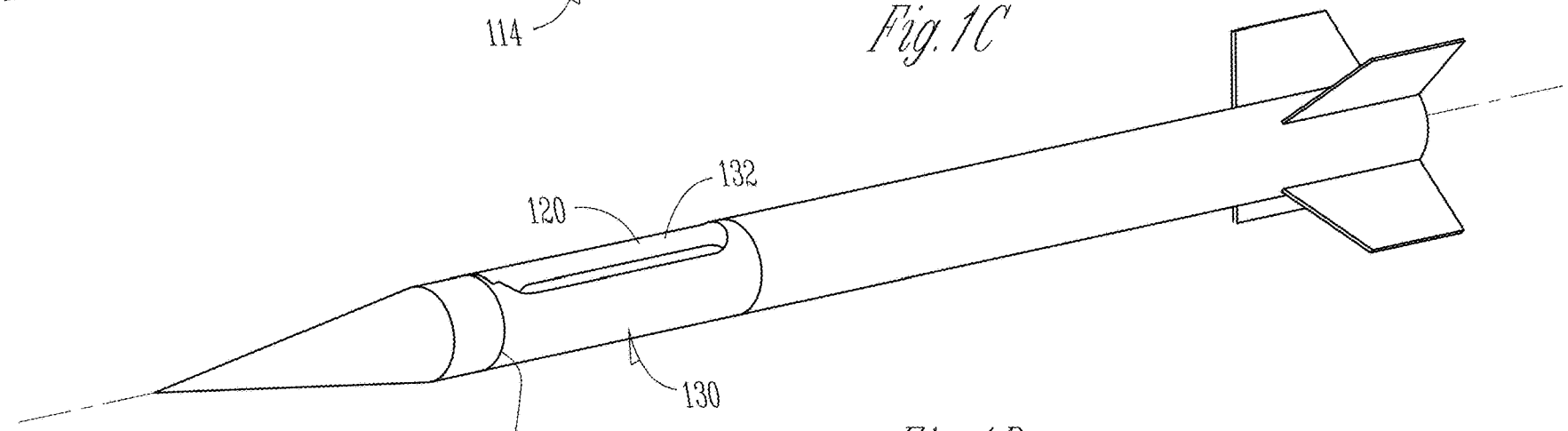

The present disclosure provides a submunition assembly to be stored and deployed from an aerial vehicle, particularly a supersonic vehicle, that subsequent to deployment releases a submunition. The submunition assembly includes a container having at least first and second walls that are joined at one end by a hinge that together define a volume along an axis perpendicular to the hinge that contains a submunition.

The submunition assembly is suitably axially-shaped with a rigid parachute panel positioned around the hinge to separate and deploy a parachute. The container may have an internal volume that is conformal to the submunition. The container may have an exterior shape that is either optimized for free-fall or has a portion that provides a conformal surface for the aerial vehicle. The submunition assembly may be configured so that all processing, memory and data resides with the submunition, which issues any and all commands to control the container including separation of the rigid parachute panel and opening of the container to release the submunition.

The submunition assembly of the present disclosure may be stored and deployed from an aerial vehicle in different ways. The submunition assembly may be carried inside the vehicle and deployed through a door that opens and closes to deploy submunitions. The submunition assembly may be positioned inside the vehicle to provide a portion of the conformal surface of the vehicle. The submunition assembly can be deployed by being ejected or pivoted into the airstream. Depending on the mission, a mechanism may be configured to restore the conformal surface to preserve the aerodynamics of the vehicle. The mission can dictate the exterior shape of the assembly to provide a portion of the conformal surface or aerodynamic properties during separation and free-fall. Without loss of generality, the submunition assembly will be described in the context of an aerial vehicle and deployment system in which the assembly provides a conformal surface to complete the OML of the airframe in flight and pivots into the airflow to be released from the airframe.

Referring now to FIGS. 1A-1D, an embodiment of missile 100 includes a propulsion module 102 having four fins 104 spaced at 90 degrees around the airframe, a payload module 106 including a pair of submunition assemblies 108 stored tip-to-tail and a guidance module 110. Each submunition assembly provides a conformal surface 111 that forms a portion of the airframe's exterior surface. Generally speaking, a "conformal surface" is one that matches the size and shape of the airframe, leaving the size and angle between corresponding curves unchanged. These submunition assemblies 108 pivot about an aft hinge point to deploy radially with respect to an axis 112 and are released from the airframe. The four fins 104 suitably have a rotational offset of 45 degrees with respect to the axis 112 and submunition assemblies 108 to reduce the chance of impact with the submunition assemblies as they clear the airframe.

Payload module 106 includes a strongback 114 having a cylindrical shape about axis 112. Strongback 114 includes a pair of axial openings 116 and 118 separated by panels 120 and 122. A skin 124 also having a cylindrical shape about axis 112 is positioned to rotate about strongback 114. An outer diameter of the strongback is typically at least 5 times a thickness of the skin. Skin 124 is relatively thin compared to the strongback. This allows mass to be allocated to the strongback to improve strength and rigidity of the payload module. Skin 124 includes a pair of axial openings 126 and 128 separated by panels 130 and 132. The axial openings 126 and 128 and the panels 130 and 132 each have sufficient surface area to cover the openings in the strongback. Pre-deployment, the submunition assemblies 108 are positioned in the openings 116 and 118 in the strongback and extend into the openings 126 and 128 level with skin 124 to complete an OML 134 of the airframe. Longitudinal edges of the openings in the skin are configured to interface with longitudinal edges of the submunition assembly's conformal surface 111 to provide a smooth OML 134. Rotation of the skin 124 is prevented by interference of skin 124 and the conformal surface 111 at this interface. Post-deployment and once the submunition assemblies clear the airframe, skin 124 rotates about the axis 112 relative to strongback 114 such that the skin's panels 130 and 132 are positioned to cover the openings 116 and 118 in strongback 114. The longitudinal edges of the openings in the skin taper to exposed surfaces of the strongback to complete OML 134.

In different embodiments, the submunition assemblies 108 and openings in the strongback and skin may be axial or radial as defined by a length/width ratio. The length being measured along the axis and the width across the axis. If the ratio is 1:1 or greater the opening is considered to be axial. In some embodiments the ratio is at least 2:1, 3:1 or even 20:1. If the ratio is less than 1:1 the opening is considered to be radial.

Figure 2A:
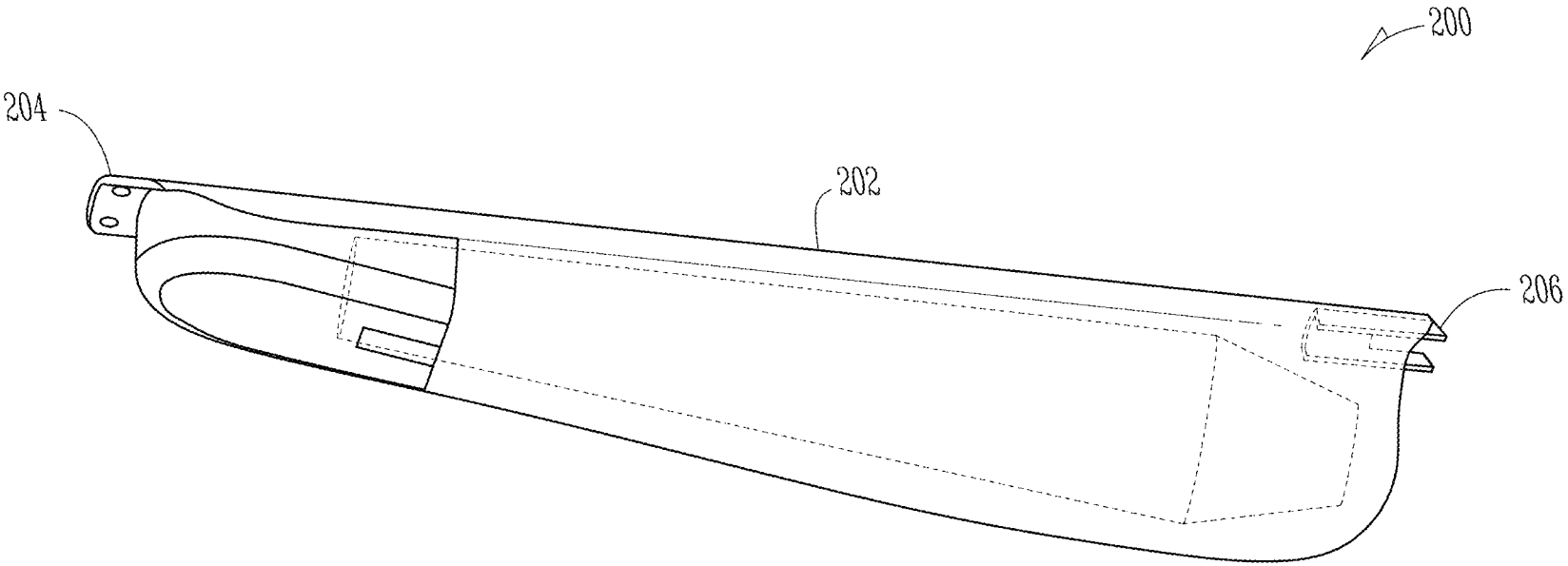
FIGS. 2A-2D illustrate the submunition assembly and aspects of the assembly to complete the OML and then to release the assembly.

Referring now to FIGS. 2A-2D, an embodiment of a submunition assembly 200 is configured to be securely stowed within a payload module to provide a smooth OML and, at deployment, to pivot into the airflow and separate from the payload module. As shown in FIG. 2A, submunition assembly 200 has an exterior surface 202 that provides a conformal surface for an airframe. In other embodiments, the exterior surface may not provide a conformal surface but may be designed solely for aerodynamic considerations during separation and free-fall. A lock bracket 204 and a pivot bracket 206 are positioned at opposing ends of the submunition assembly.

Figure 2B:
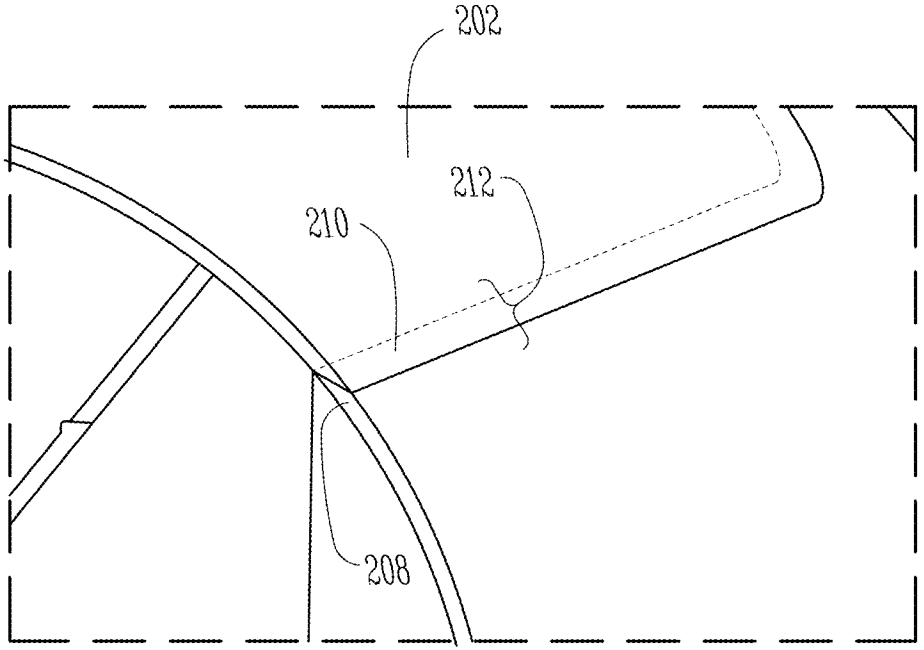

As shown in FIG. 2B, longitudinal edges 208 of the openings in the skin are configured to interface with longitudinal edges 210 of the submunition assembly's exterior and conformal surface 202 to provide a smooth OML 212.

Figure 2C:
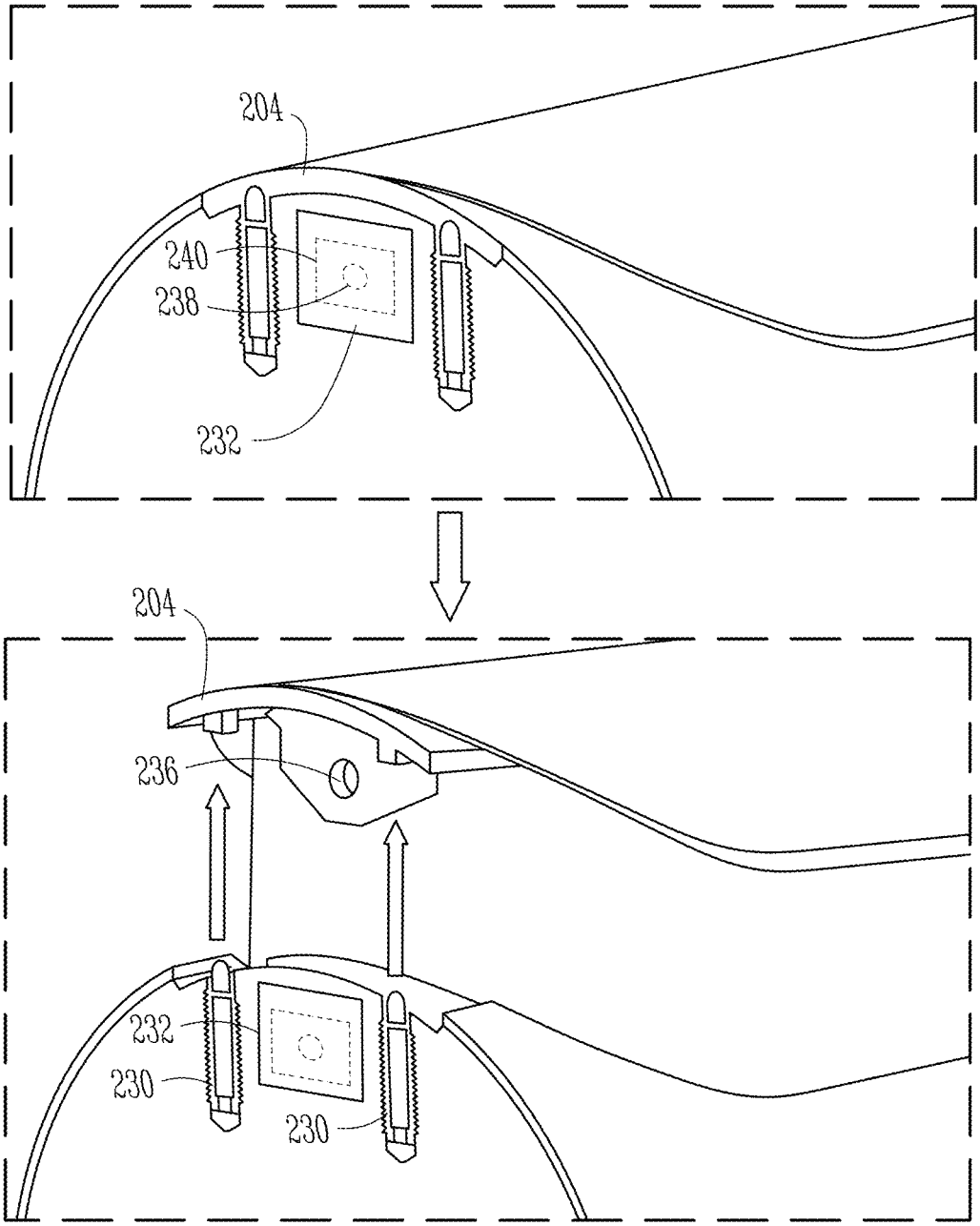

As shown in FIG. 2C, a deployment assembly is configured to deploy each submunition assembly through the aligned openings in the strongback and skin. Each deployment assembly includes a pair of slotted spring plungers 230 positioned and pre-biased to exert an outward force on the submunition assembly and a locking unit 232 to secure the submunition assembly. At deployment the locking unit 232 releases the submunition assembly and the pair of slotted spring plungers 230 exert the outward force on the submunition to deploy the submunition assembly through the aligned openings in the strongback and skin. Locking unit 232 includes lock bracket 204 having a receptacle 236 on one end of the submunition assembly positioned forward in the opening in the strongback, a rod 238 positioned to move into and out of the receptacle and an actuator 240 configured to move the rod. The actuator may be a solenoid valve actuator in which current is applied and an EM field is generated through the coils, which pulls back the rod 238. When current is stopped, the rod is passively pushed forward.

Figure 2D:
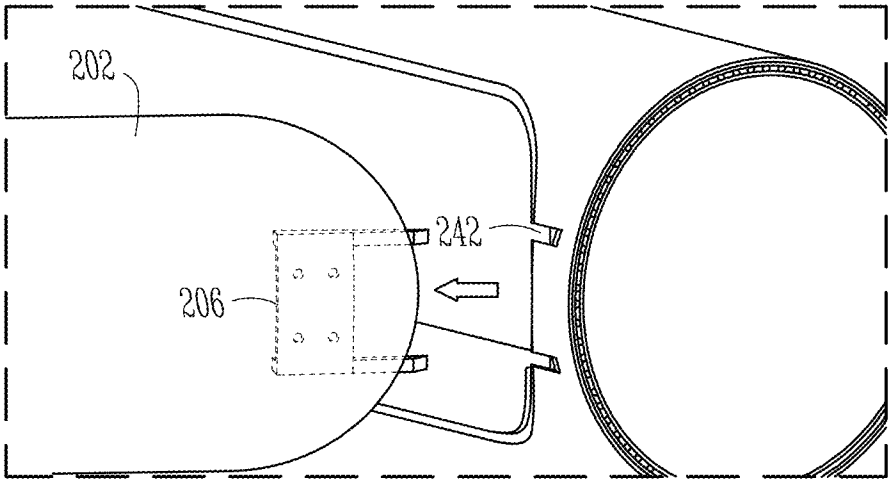

As shown in FIG. 2D, each deployment assembly further includes a hinge bracket 242 positioned aft in the opening in the strongback and the pivot bracket 206 at one end of the submunition assembly below the conformal surface 202 positioned aft in the opening in the strongback to engage the hinge bracket 242. At deployment, the submunition assembly pivots radially outward away from the strongback and upon reaching a preset angle separates from the hinge bracket 242.

Figure 3:
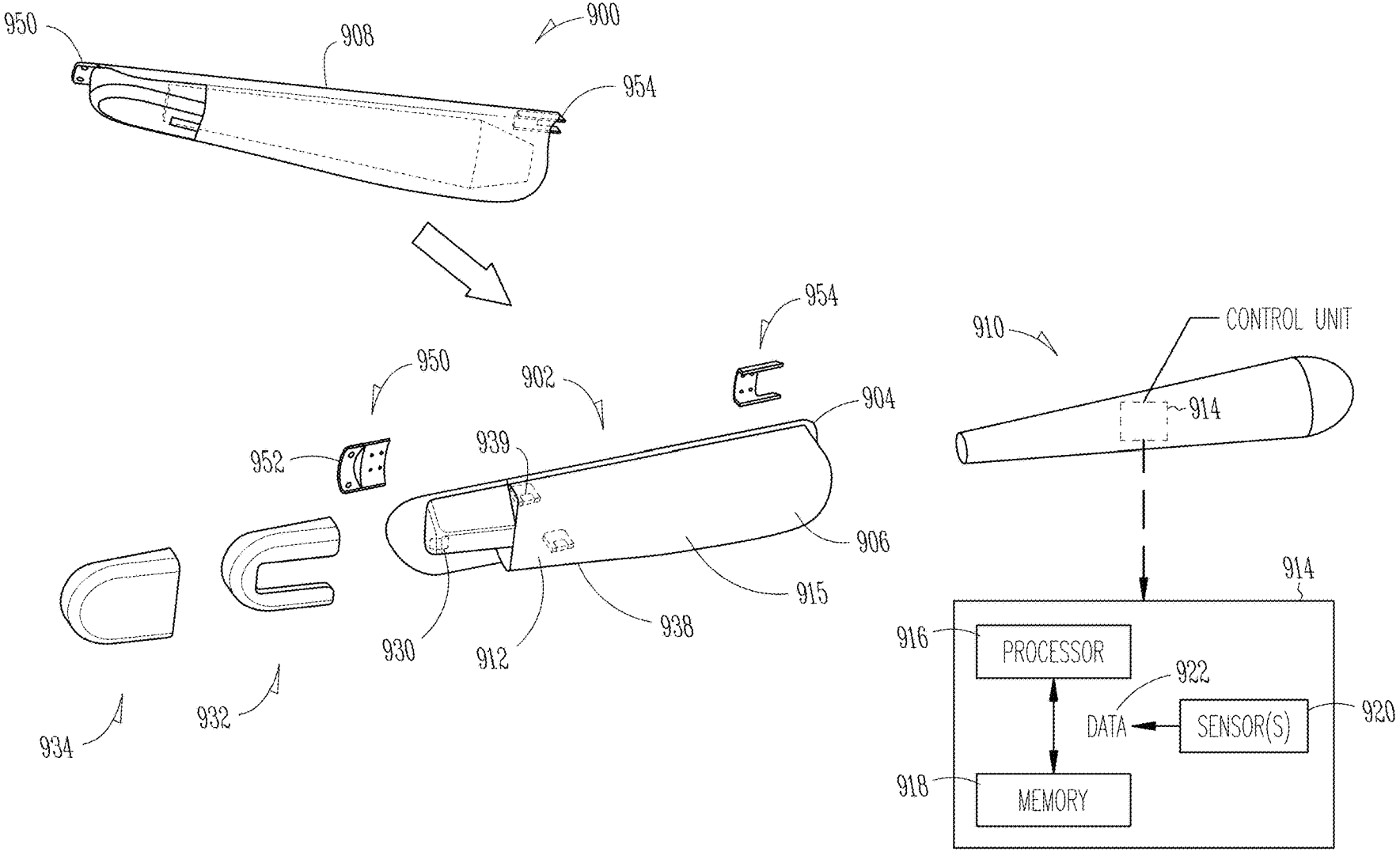
FIG. 3 is an exploded view of an embodiment of a submunition assembly.
Figure 4A:
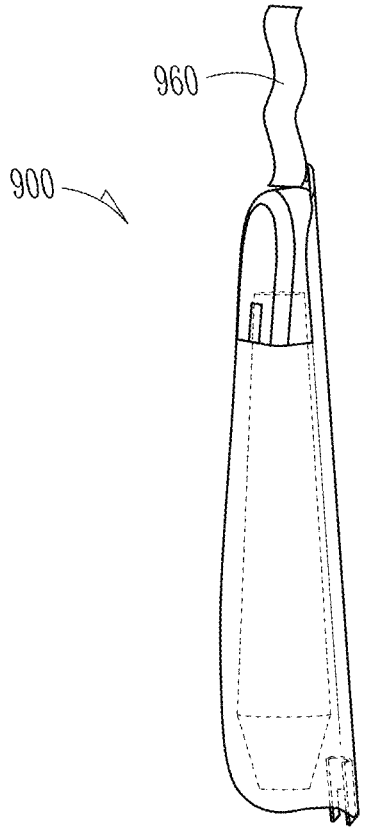
FIGS. 4A-4F illustrate an embodiment of a sequence for deploying the conformal container and releasing the submunition.
Figure 4B:
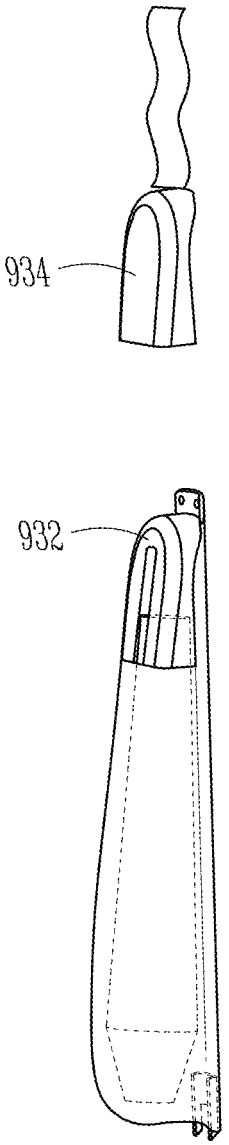
Figure 4C:
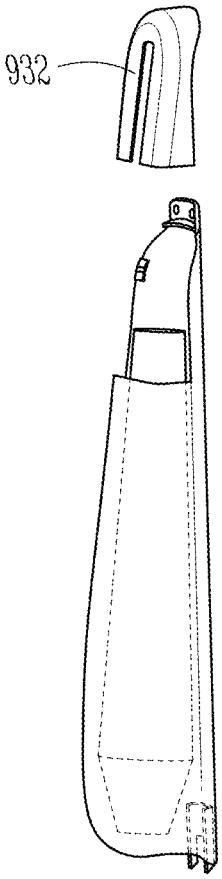
Figure 4D:
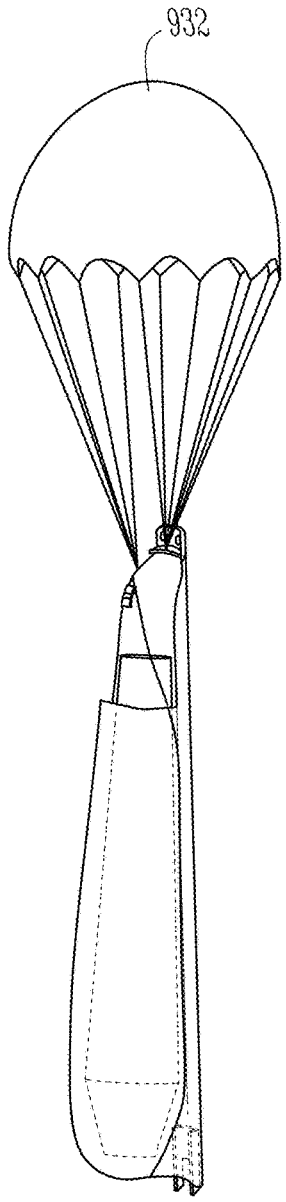
Figure 4E:
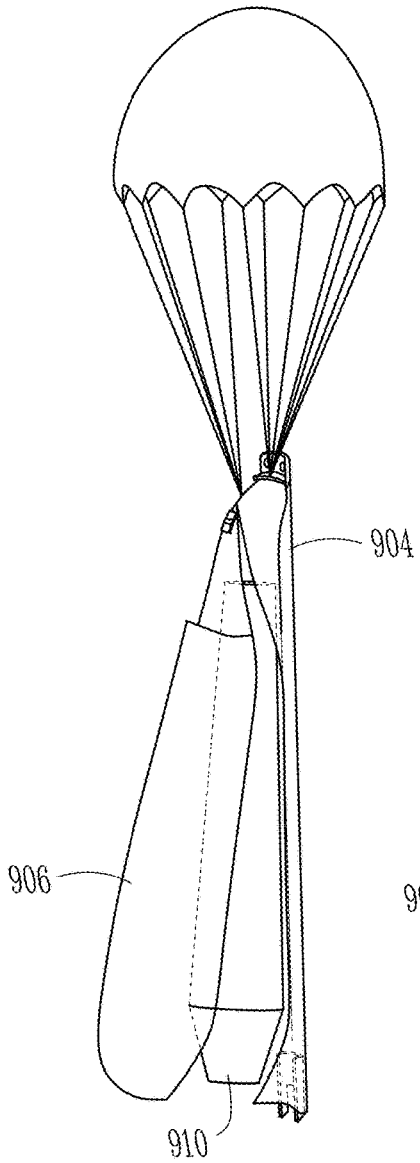
Figure 4F:
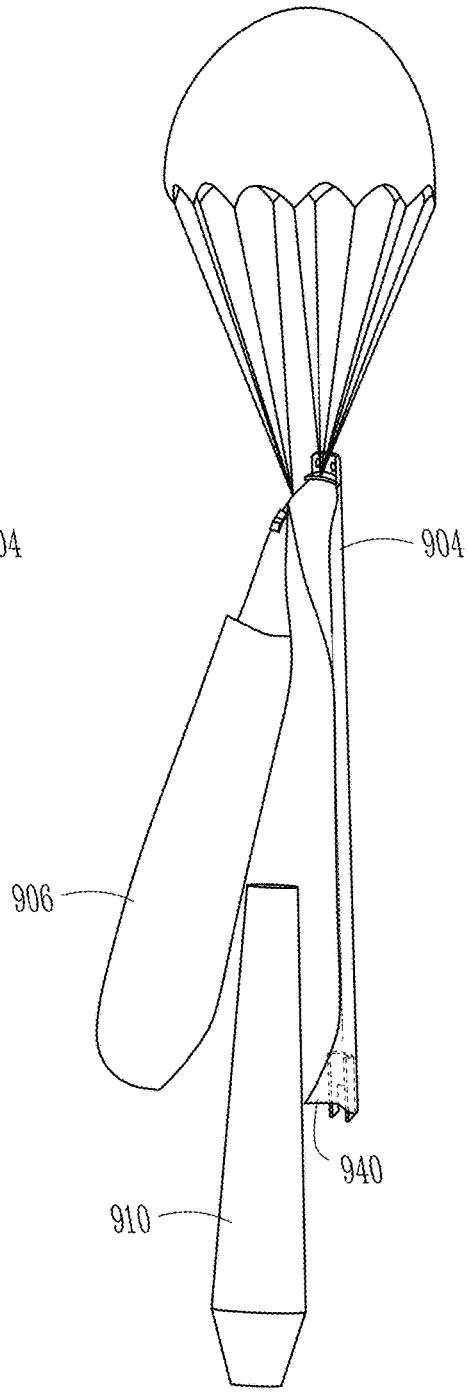

Referring now to FIG. 3, an embodiment of a submunition assembly 900 includes a container 902 having separable first and second walls 904 and 906 that define a volume, at least a portion of one of the first and second walls have an exterior shape that provides the conformal surface 908 of the submunition assembly, a submunition 910 positioned within the volume inside the container; and a mechanism 912 (e.g., a latch) on the container to hold the first and second walls together to secure the volume and upon receipt of a command signal to separate the first and second walls to open the container and release the submunition. The exterior shape of the remaining portion of the container depends largely on the shape of submunition 910 and the volume inside the strongback. The exterior shape factors into the aerodynamics as the conformal container should be stable during separation and free-fall before releasing the submunition.

Container 902 provides environmental protection to the submunition 910 during separation and free-fall. The container volume may conform to the shape of the submunition 910. The volume may include padding or packing material 915 to absorb shock loads, and offer with environmental protection (thermal, water, air, dust, etc.).

Submunition 910 includes a control unit 914 configured to issue the command signal to actuator 938 to release mechanism 912 to open the container and release the submunition. Control unit includes a processor 916 and memory 918 and one or more sensor 920 (e.g., speed or altitude) to process data 922 to issue the command signal. The control unit is suitably hardwired to actuators in the container. Any and all processors, memory, sensors or data stored in memory or processed by the processor resides only with the submunition. Consequently, when the container falls away there is nothing of value to recover.

The container is axially-shaped having a length/width ratio of at least 1:1 and suitably at least 3:1. The walls joined at one end by a hinge 930 that defines the volume along an axis perpendicular to the hinge. A parachute 932 is stored in a rigid U-shaped parachute panel 934 positioned around the hinge 930 at one end of the container. Upon receipt of a parachute command from the submunition's control unit, an actuator 939 separate the parachute panel 934 from the container and allow the parachute 932 to deploy to slow the submunition assembly during free-fall. Upon receipt of the release command, the mechanism 912 and actuator 938 unlocks the walls allowing them to pivot about the hinge 930 to separate and release the submunition. The ends of the walls within the volume and opposite the hinge are suitably provided with wedges 940 that are engaged by the submunition under the force of gravity to assist with opening of the container.

To store and deploy submunition 910 from an airframe, container 902 includes a lock bracket 950 having a receptacle 952 and a pivot bracket 954 positioned at opposing ends of the container to receive a rod on the airframe and to engage a complementary hinge bracket positioned aft in the axial opening of the airframe. To initiate deployment the rod is retracted and the container pivots away from the airframe and is released to free-fall.

Referring now to FIGS. 4A-4F, once deployed from the airframe and payload module, a streamer 960 is deployed to orient the submunition assembly 900 during free-fall. At a determined speed or altitude, the submunition's control unit issues the parachute command that commands the actuators to separate the parachute panel 934 allowing the parachute 932 to deploy and open. At a determined speed or altitude, the submunition's control unit issues the release command that commands the actuators to allow the walls to open. Under the force of gravity, the submunition 910 pushes apart the walls opposite the hinge, assisted by the wedges, to separate from container 902.

While several illustrative embodiments of the disclosure have been shown and described, numerous variations and alternate embodiments will occur to those skilled in the art. Such variations and alternate embodiments are contemplated, and can be made without departing from the spirit and scope of the disclosure as defined in the appended claims.

We claim:

1. A submunition assembly for deployment from an airframe, the submunition assembly comprising:

a container having first and second walls joined at one end by a hinge that define a volume along an axis perpendicular to the hinge, said container having a length/width ratio of at least 1:1;

a submunition positioned within the volume inside the container;

a streamer deployed to orient the container during free-fall; and a parachute stored in a rigid parachute panel positioned around the hinge at the one end of the container, upon receipt of a parachute command said parachute panel configured to separate from the container and allow the parachute to deploy to slow the submunition assembly during free-fall, wherein upon receipt of a release command the container's first and second walls are allowed to pivot about the hinge to separate and release the submunition.

2. The submunition assembly of claim 1, wherein the length/width ratio is at least 2:1.

3. The submunition assembly of claim 1, wherein the rigid parachute panel is U-shaped to position around the hinge.

4. The submunition assembly of claim 1, wherein an interior of the container has a conformal shape to the submunition.

5. The submunition assembly of claim 4, further comprising padding within the interior of the container to absorb shock loads.

6. The submunition assembly of claim 4, wherein the ends of the first and second walls opposite the hinge include wedges that are engaged by the submunition to assist with opening of the container.

7. The submunition assembly of claim 1, further comprising:

a first actuator configured to eject the parachute panel upon receipt of the parachute command; and a second actuator configured to separate the container's first and second walls upon receipt of the release command.

8. The submunition assembly of claim 7, wherein said submunition comprises a control unit configured to issue the parachute and release command signals.

9. The submunition assembly of claim 1, wherein the submunition's control unit is hardwired to the first and second actuators.

10. The submunition assembly of claim 1, wherein the control unit includes a processor and memory to process data to issue the command signal, wherein any and all processors or memory or data stored in memory or processed by the processor resides only with the submunition.

11. The submunition assembly of claim 1, wherein at least a portion of the first or second walls of the container has a conformal shape to complete an outer mold line (OML) of an airframe.

12. The submunition assembly of claim 11, wherein the container further comprises a lock bracket having a receptacle and a pivot bracket positioned at opposing ends of the container to receive a rod on the airframe and to engage a complementary hinge bracket positioned aft in the axial opening of the airframe, wherein upon deployment the rod is retracted and the container pivots away from the airframe and is released to free-fall.

13. A submunition assembly for storage and deployment from an axial opening in an airframe having an outer mold line (OML), the submunition assembly comprising:

a container having first and second walls joined at one by a hinge that define a volume along an axis perpendicular to the hinge, said container having a length/width ratio of at least 1:1, at least a portion of one of the first and second walls having an exterior shape that provides a conformal surface within the axial opening to the airframe's OML;

a submunition positioned within the volume inside the container;

a lock bracket having a receptacle and a pivot bracket positioned at opposing ends of the container to receive a rod on the airframe and to engage a complementary hinge bracket positioned aft in the axial opening of the airframe, wherein upon deployment the rod is retracted and the container pivots away from the airframe and is released to free-fall;

a streamer deployed to orient the container during free-fall; and a parachute stored in a rigid parachute panel positioned around the hinge at one end of the container, upon receipt of a parachute command said parachute panel configured to separate from the container and allow the parachute to deploy to slow the submunition assembly during free-fall, wherein upon receipt of a release command the container's first and second walls are allowed to pivot about the hinge to separate and release the submunition.

14. The submunition assembly of claim 13, further comprising:

a first actuator configured to eject the parachute panel upon receipt of the parachute command; and a second actuator configured to separate the container's first and second walls upon receipt of the release command, wherein the submunition's control unit is hardwired to the first and second actuators, wherein said submunition comprises a control unit including a processor and memory configured to process data to issue the parachute and release command signals, wherein any and all processors or memory or data stored in memory or processed by the processor resides only with the submunition.

15. A submunition assembly, comprising:

a container having separable first and second walls that define a volume;

a first mechanism on the container to hold the first and second walls together to secure the volume, and a submunition positioned within the volume inside the container, said submunition comprising a control unit configured to issue a command signal to the mechanism to separate the first and second walls to open the container and release the submunition.

16. The submunition assembly of claim 15, wherein the submunition's control unit is hardwired to the first mechanism.

17. The submunition assembly of claim 15, wherein the control unit includes a processor and memory to process data to issue the command signal, wherein any and all processors or memory or data stored in memory or processed by the processor resides only with the submunition.

18. The submunition assembly of claim 15, further comprising:

a parachute stored in a rigid parachute panel positioned at one end of the container;

a second mechanism configured to eject the rigid parachute panel, wherein the submunition's control unit issues a parachute signal to the second mechanism to eject the rigid parachute panel.

19. The submunition assembly of claim 18, wherein the submunition's control unit is hardwired to the first and second mechanisms.

20. The submunition assembly of claim 15, wherein the container has a length/width ratio of at least 2:1, wherein the first and second walls are joined at one end by a hinge.

* * * * *